US007706729B2

(12) United States Patent
Tsunoda

(10) Patent No.: US 7,706,729 B2
(45) Date of Patent: Apr. 27, 2010

(54) DEVELOPING DEVICE WITH PADDLE MEMBER AND IMAGE FORMING APPARATUS

(75) Inventor: Arihiro Tsunoda, Tokyo (JP)

(73) Assignee: Oki Data Corporation, Tokyo (JP)

( * ) Notice: Subject to any disclaimer, the term of this patent is extended or adjusted under 35 U.S.C. 154(b) by 618 days.

(21) Appl. No.: 11/708,484

(22) Filed: Feb. 21, 2007

(65) Prior Publication Data

US 2007/0212124 A1 Sep. 13, 2007

(30) Foreign Application Priority Data

Mar. 13, 2006 (JP) ..... 2006-066918

(51) Int. Cl.
*G03G 15/08* (2006.01)

(52) U.S. Cl. ..... 399/281

(58) Field of Classification Search ..... 399/254, 399/258, 272, 281
See application file for complete search history.

(56) References Cited

U.S. PATENT DOCUMENTS 5,899,607 A * 5/1999 Kawaguchi et al. ..... 399/254
6,560,430 B2 * 5/2003 Muto et al. ..... 399/281
7,277,666 B2 * 10/2007 Kawano et al. ..... 399/281

FOREIGN PATENT DOCUMENTS

JP 2005-172842 6/2005

* cited by examiner

*Primary Examiner*—William J Royer
(74) *Attorney, Agent, or Firm*—Kubotera & Associates, LLC

(57) ABSTRACT

An image forming unit includes an image supporting member for forming a latent image; a developer supporting member for attaching developer to the latent image to develop the latent image; a developer supply member facing the developer supporting member for supplying the developer to the developer supporting member; and a first developer pushing member facing the developer supply member to be freely rotatable for supplying the developer to the developer supply member. The first developer pushing member includes a first rod member disposed substantially in parallel to the developer supply member, so that the rod member moves close to the developer supply member equal to or more than 2.50 times when the developer supply member rotates one rotation.

14 Claims, 7 Drawing Sheets

DEVELOPING DEVICE WITH PADDLE MEMBER AND IMAGE FORMING APPARATUS

BACKGROUND OF THE INVENTION AND RELATED ART STATEMENT

The present invention relates to an image forming unit and an image forming apparatus.

In a conventional image forming apparatus such as a printer, a copier, and a facsimile, an image is formed through the following process. First, a charge roller uniformly and constantly charges a surface of a photosensitive drum. An exposure device such as an LED head exposes the surface of the photosensitive drum to form a static latent image or a latent image thereon. A developing roller develops the static latent image to form a toner image. A transfer roller transfers the toner image to a sheet. After transferring the toner image, the sheet is transported to a fixing device, so that the fixing device fixes the toner image to the sheet. In the process, after transferring the toner image, part of the toner image may remain on the photosensitive drum, and a cleaning device removes the remaining toner.

A toner image supply roller is disposed to abut against the developing roller for supplying toner to the developing roller. A toner supply paddle is disposed at an upstream side of the developing roller to be freely rotatable in a cycle for supplying toner to the toner supply roller. An image forming unit (developing device) is formed of the photosensitive drum, the charge roller, the developing roller, the toner supply roller, the toner supply paddle, the cleaning device, and the like (refer to Patent Reference).

Patent Reference: Japanese Patent Publication No. 2005-172842

In the conventional image forming apparatus described above, when an image is formed continuously or a continuous printing operation is performed, it is possible to prevent a blurred portion. However, it is difficult to prevent visible fog in a white portion of a sheet, thereby deteriorating print quality.

In view of the problems described above, an object of the present invention is to provide an image forming unit and an image forming apparatus, in which it is possible to solve the problems of the conventional image forming unit and improve print quality.

Further objects and advantages of the invention will be apparent from the following description of the invention.

SUMMARY OF THE INVENTION

In order to attain the objects described above, according to the present invention, an image forming unit includes an image supporting member for forming a latent image; a developer supporting member for attaching developer to the latent image on the image supporting member to develop the latent image; a developer supply member facing the developer supporting member for supplying developer to the developer supporting member; and a first developer pushing member facing the developer supply member to be freely rotatable for supplying developer to the developer supply member. The first developer pushing member includes a rod member disposed substantially in parallel to the developer supply member. When the developer supply member rotates one rotation, the rod member moves close to the developer supply member equal to or more than 2.50 times.

In the image forming unit of the present invention, when the developer supply member rotates one rotation, the rod member moves close to the developer supply member equal to or more than 2.50 times. Accordingly, when an image is formed continuously, it is possible to prevent fog on a recording medium, thereby improving print quality.

DETAILED DESCRIPTION OF PREFERRED EMBODIMENTS

Hereunder, embodiments of the present invention will be explained with reference to the accompanying drawings. In the embodiments, a color printer will be explained as an image forming apparatus for forming an image.

First Embodiment

Figure 2:
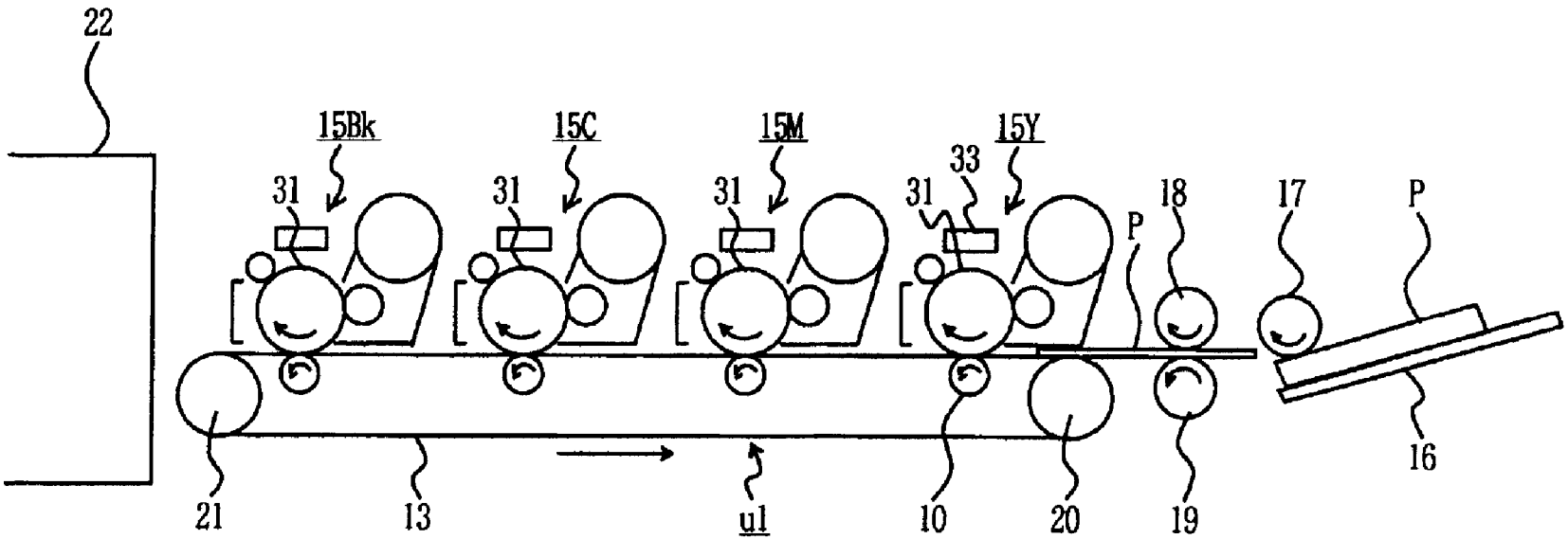
FIG. 2 is a schematic view showing a printer according to the first embodiment of the present invention.

A first embodiment of the present invention will be explained. FIG. 2 is a schematic view showing a printer according to the first embodiment of the present invention.

As shown in FIG. 2, in the printer, image forming units (developing devices) 15Bk, 15Y, 15M, and 15C are arranged in a row for forming images in black, yellow, cyan, and magenta using toner in the different colors.

In the embodiment, each of the image forming units 15Bk, 15Y, 15M, and 15C is provided with a photosensitive drum 31 as an image supporting member. A transfer unit u1 is disposed below the photosensitive drums 31 over the image forming units 15Bk, 15Y, 15M, and 15C. An LED head 33 formed of LEDs is disposed above each of the photosensitive drums 31.

The transfer unit u1 includes an idle roller 20 as a first roller; a drive roller 21 as a second roller; a transfer belt 13 placed between the drive roller 21 and the idle roller 20 for transporting a sheet P as a recording medium; and transfer rollers 10 as transfer members. A power source (not shown) applies a voltage to the transfer belt 13 and the transfer rollers 10, so that a toner image is transferred to the sheet P.

In the embodiment, the printer also includes a tray 16 as a medium storage unit for storing the sheet P; a hopping roller 17 as a sheet supply member for picking up and supplying the sheet P from the tray 16; a resister roller 18 (pressure roller) for transporting the sheet P to the transfer belt 13; a resister roller 19 for transporting the sheet P without skew; and a fixing unit 22 as a fixing device for fixing a toner image on the sheet P.

In the embodiment, the printer further includes a print control unit as an image forming control unit for controlling a sequence of the printer as a whole and performing a printing operation; an interface (I/F) control unit for receiving print data and a control command; a reception memory for temporarily storing the print data received through the interface control unit; an image editing memory for receiving the print data stored in the reception memory and storing image data to be formed through editing the print data; a display light source for displaying a status of the printer; an operational panel having a switch and the like for an operator to input a direction to the printer; various sensors for watching an operational status of the printer such as a sheet position sensor for detecting a position of the sheet P, a temperature and humidity sensor for detecting a temperature and humidity, and a sensor for detecting a dot density; a power source for each of the rollers; a head control unit for sending the image data stored in the image data editing memory to the LED heads 33 to drive the LED heads 33; a fixing control unit for applying a voltage to the fixing unit 22; and a drive control unit for driving a drum motor as a drive unit for rotating the photosensitive drums 31.

In the embodiment, the print control unit includes a microprocessor (CPU); a storage unit such as a ROM and a RAM; an input/output port; a timer; and the like. The print control unit functions as a computer according to a program.

The image forming units 15Bk, 15Y, 15M, and 15C will be explained in more detail next. Since the image forming units 15Bk, 15Y, 15M, and 15C have an identical internal configuration, only the image forming unit 15Y will be explained.

Figure 1:
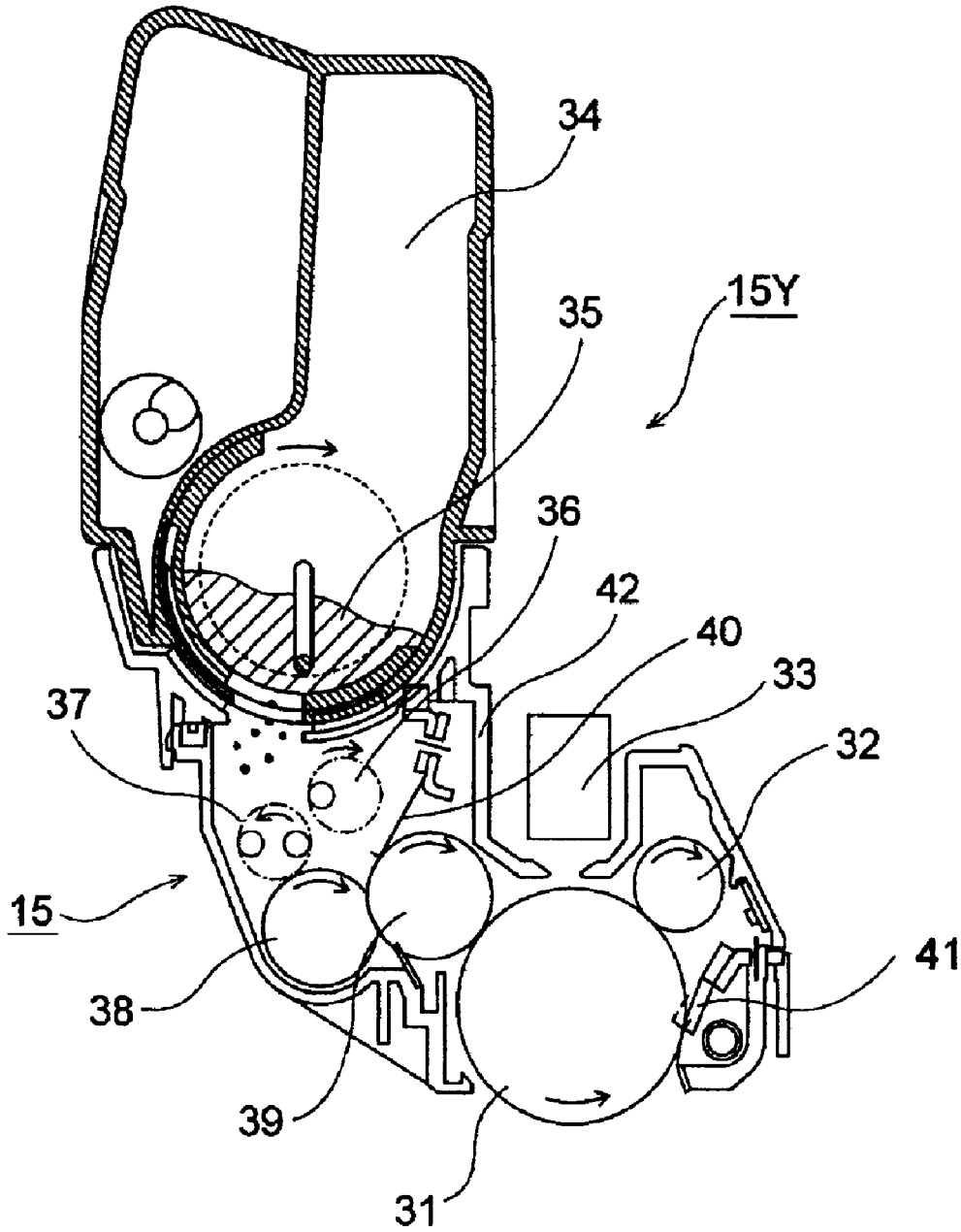
FIG. 1 is a schematic sectional view showing an image forming unit according to a first embodiment of the present invention.

FIG. 1 is a schematic sectional view showing the image forming unit 15Y according to the first embodiment of the present invention.

As shown in FIG. 1, the image forming unit 15Y includes the photosensitive drum 31 rotating in an arrow direction at a specific speed and capable of accumulating charges on a surface thereof in which charges on the surface are removed upon exposure; and a charging roller 32 as a charging device for uniformly applying a specific voltage to the surface of the photosensitive drum 32. The charging roller 32 contacts with the photosensitive drum 31 at a specific pressure, and rotates in a direction (arrow direction) opposite to that of the photosensitive drum 31.

In the embodiment, the image forming unit 15Y further includes the LED head 33 disposed on a main body of the printer above the photosensitive drum 31 for forming a static latent image or a latent image on the surface of the photosensitive drum 31; and a toner storage container 34 disposed at an upper portion of the image forming unit 15Y for storing toner 35. Accordingly, the toner 35 is supplied from the toner storage container 34 to a unit main body 15 of the image forming unit 15Y.

In the embodiment, a stirring member 36 is disposed under the toner storage container 34 for stirring the toner 35 supplied from the toner storage container 34. A toner transportation paddle 37 with a tuning fork shape is disposed adjacent to the stirring member 36 as a supplement charging member or a developer pushing member for supplying the toner 35 to a toner supply roller 38.

In the embodiment, the toner supply roller 38 is pressed against a developing roller 39 with a specific pressure, and rotates in a direction (arrow direction) the same as that of the developing roller 39 for supplying the toner 35 to the developing roller 39. A developing blade 40 is disposed as a developer restricting member such that a distal end portion thereof contacts with the developing roller 39 for restricting a thickness of the toner 35 on the developing roller 39 at a constant level. Further, the developing roller 39 is pressed against the photosensitive drum 31 with a specific pressure, and rotates in a direction (arrow direction) opposite to that of the photosensitive drum 31 for attaching the toner 35 to the latent image to form a toner image.

A cleaning blade 41 formed of an elastic member contacts with the surface of the photosensitive drum 31 with a specific pressure for scraping the toner 35. A cleaning device is formed of the cleaning blade 41, a transportation unit for transporting the toner 35 thus scraped to the toner storage container 34, and the like. A housing 42 constitutes an external member of the image forming unit 15Y.

Figure 3:
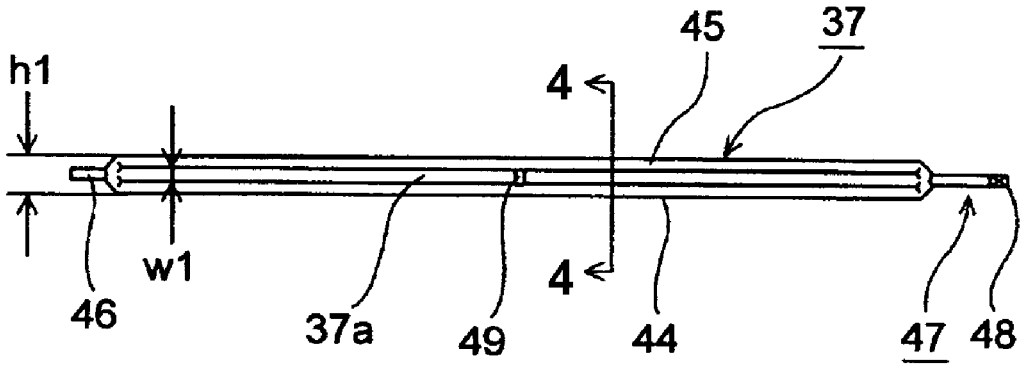
FIG. 3 is a schematic front view showing a toner transportation paddle according to the first embodiment of the present invention.
Figure 4:
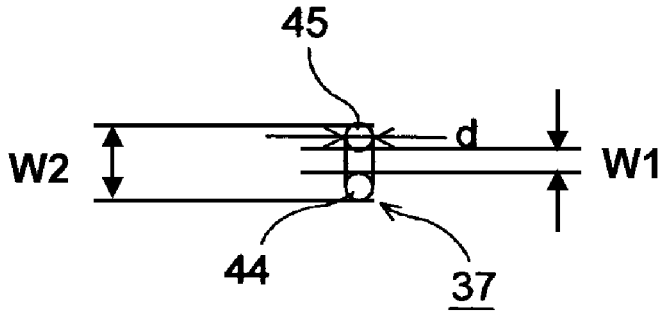
FIG. 4 is a schematic sectional view taken along a line 4-4 in FIG. 3 according to the first embodiment of the present invention.

The toner transportation paddle 37 will be explained in more detail. FIG. 3 is a schematic front view showing the toner transportation paddle 37 according to the first embodiment of the present invention. FIG. 4 is a schematic sectional view taken along a line 4-4 in FIG. 3 according to the first embodiment of the present invention.

In the embodiment, the toner transportation paddle 37 has a dimension in an axial direction substantially the same as that of the toner supply roller 38 (FIG. 1) and a specific width h1. Further, the toner transportation paddle 37 is formed of a linear member with a circular cross section, and includes two rod members 44 and 45 having an outer diameter d (in the embodiment, d=1.0 mm) and end portions connected to each other. The toner transportation paddle 37 is provided with rotational shafts 46 and 47 at end portions thereof, so that the toner transportation paddle 37 rotates around the rotational shafts 46 and 47.

In the embodiment, the rod members 44 and 45 are arranged in parallel to the toner supply roller 38 with a specific space w1 (in the embodiment, w1=5.0 mm) therebetween. A space 37*a* is formed between the rod members 44 and 45 for the toner 35 passing therethrough. A connecting portion 49 is disposed at a middle portion of the toner transportation paddle 37 for connecting the rod members 44 and 45. It is preferred that the outer diameter d of the rod members 44 and 45 is equal to 1.0 mm, and the specific space w1 between the rod members 44 and 45 is equal to or greater than 5.0 mm. Accordingly, a width w2 of the toner transportation paddle 37 is preferably equal to or greater than 7.0 mm. In the embodiment, the width w2 is equal to 7.0 mm. In this case, when the toner transportation paddle 37 rotates along a path 37*b* (FIG. 5), the path 37*b* has an outer diameter 1 of 7.0 mm.

At least one of the rotational shafts 46 and 47, the rotational shaft 47 in the embodiment, has a cut portion to form a rotational transmission portion 48 with a semi-circular section. The rotational transmission portion 48 is connected to a motor (not shown) as a drive unit through a rotational transmission mechanism such as a gear, so that the toner transportation paddle 37 rotates at a specific rotational speed.

In the embodiment, the toner transportation paddle 37 rotates periodically at an upstream side of a nip portion between the toner supply roller 38 and the developing roller 39 in a rotational direction of the toner supply roller 38. Accordingly, the rod members 44 and 45 periodically approach the toner supply roller 38. With this configuration, it is possible to supply the toner 35 to the toner supply roller 38 and prevent fog (surface fog).

Figure 5:
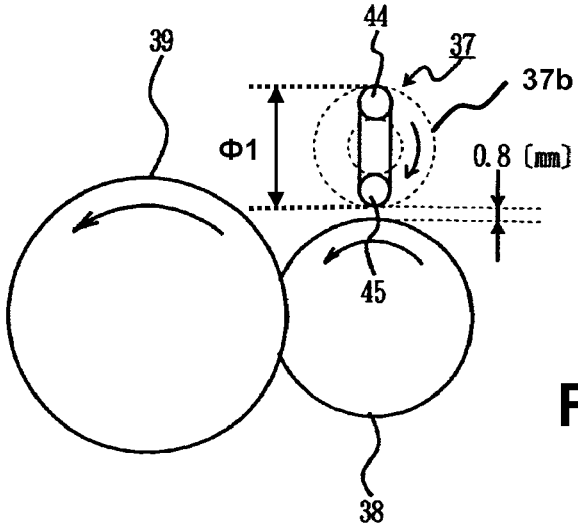
FIG. 5 is a schematic view showing a relationship between a toner supply roller and the toner transportation paddle according to the first embodiment of the present invention.

An operation of the image forming unit 15Y will be explained next. FIG. 5 is a schematic view showing a relationship between the toner supply roller 38 and the toner transportation paddle 37 according to the first embodiment of the present invention.

In the embodiment, the image forming unit 15Y performs a developing process of one-component developing type, in which one-component developer is used as the toner 35 (FIG. 1). An opening portion is formed at a lower portion of the toner storage container 34, so that the opening portion is freely opened and closed. When the opening is opened, the toner 35 in the toner storage container 34 in a specific amount drops and is supplied to the unit main body 15. In the unit main body 15, the stirring member 36 rotates to stir the toner 35, and the toner transportation paddle 37 rotates to supply the toner 35 to the toner supply roller 38.

When a portion of the surface of the photosensitive drum 31 is not exposed, the unexposed portion (non-image portion) has a high surface potential, thereby causing fog or drum fog. The drum fog can be represented as an amount of toner stuck (toner sticking amount) to the unexposed portion, in which a larger number represents a larger amount of stuck toner. When a potential of the toner 35 on the surface of the photosensitive drum 31 has a high value, it is difficult to cause the drum fog. In order to increase the toner potential of the toner 35 on the surface of the photosensitive drum 31, it is necessary to increase a toner potential on the toner supply roller 38.

When an image is formed continuously, fog may be generated in a white portion of the sheet P (surface fog), and is defined as a toner sticking amount in the white portion of the sheet P. In general, an extent of the drum fog is greater than an extent of the surface fog. Accordingly, in experiments described below, the drum fog was mainly evaluated.

When the charging roller 32 charges the surface of the photosensitive drum 31 at about a surface potential of minus 1,000 V and the LED head 33 exposes the surface, the exposed portion (image portion) of the photosensitive drum 31 has a surface potential of about 0 V. Then, the toner 35 is charged with negative polarity through friction, and is attached to the exposed portion with the decreased surface potential. Since the unexposed portion of the photosensitive drum 31 has the surface potential of −1,000 V, the toner 35 is not supposed to stick thereto.

However, when the toner 35 is not sufficiently charged, the toner 35 may be partially charged with positive polarity or little charge amount. As a result, the toner 35 charged with positive polarity or little charge amount may stick to the unexposed portion of the photosensitive drum 31. When the toner 35 sticks to the unexposed portion of the photosensitive drum 31, the drum fog occurs, and the toner 35 on the photosensitive drum 31 sticks to the sheet P, thereby causing the surface fog.

In the embodiment, the toner supply roller 38 rotates in the direction (arrow direction) opposite to that of the toner transportation paddle 37 at a circumferential speed different from that of the toner transportation paddle 37. The toner 35 is charged through friction (preliminary charging) at the portion where the space between the toner supply roller 38 and one of the rod members 44 and 45 (rod member 45 in FIG. 5) becomes minimum, i.e., less than 0.8 mm in the embodiment.

When the toner supply roller 38 contacts with the toner transportation paddle 37 such that the space between the toner supply roller 38 and the rod members 44 and 45 becomes 0 mm (contact state), the toner supply roller 38 tends to wear. Further, the toner 35 tends to deteriorate between the toner supply roller 38 and the rod members 44 and 45. That is, particles of the toner 35 may be crashed; an outer additive in the toner 35 may be embedded in the surface of the toner 35; or the outer additive is apart from the surface of the toner 35. Accordingly, it is preferred that the toner supply roller 38 does not contact with the toner transportation paddle 37.

Figure 6:
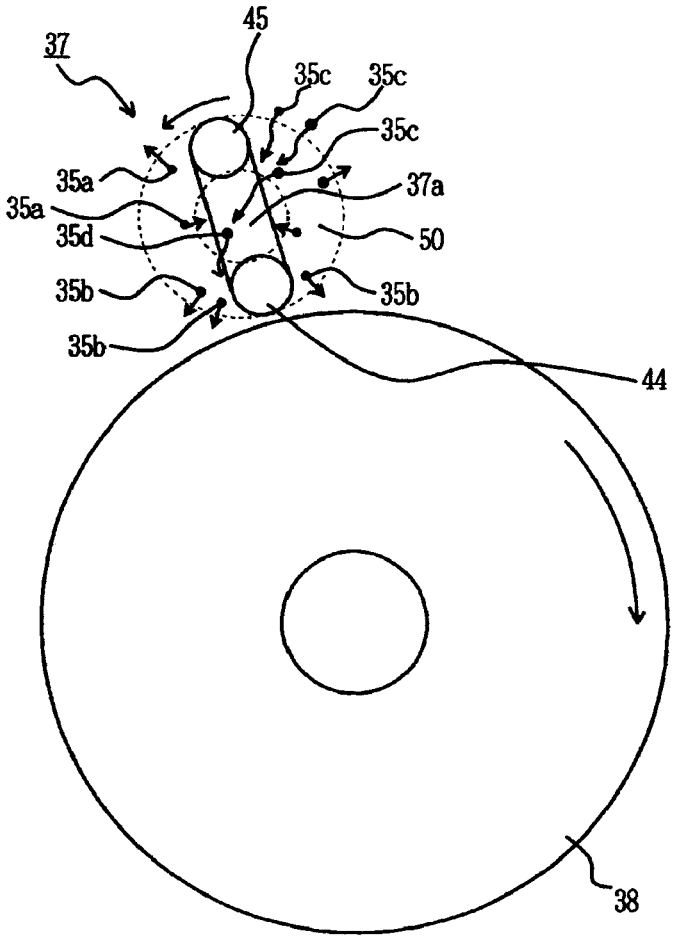
FIG. 6 is an enlarged schematic view showing the toner supply roller and the toner transportation paddle according to the first embodiment of the present invention.

FIG. 6 is an enlarged schematic view showing the toner supply roller 38 and the toner transportation paddle 37 according to the first embodiment of the present invention. As shown in FIG. 6, when the toner transportation paddle 37 rotates, toner 35*a* on a moving path 50 of the rod members 44 and 45 is pushed outward or inward from the moving path 50 while the rod members 44 and 45 are rotating. Accordingly, a space is formed on the moving path 50 while the toner transportation paddle 37 is rotating.

Further, when the toner transportation paddle 37 rotates, the rod member 45 (or rod member 44) enters the space on the moving path 50. As a result, toner 35*c* above the toner transportation paddle 37 reaches the space 37*a* between the rod members 44 and 45. Additionally, when the toner transportation paddle 37 rotates and the rod member 45 (or rod member 44) moves, toner 35*d* in a space 37*a* enters the space on the moving path 50, and further is pushed outward or inward from the moving path 50 with the rod member 45 (or rod member 44). Toner 35*b* below the toner transportation paddle 37 is pushed toward the toner supply roller 38. Accordingly, the toner transportation paddle 37 having the space 37*a* generates the flow of the toner 35, thereby preventing the toner 35 from agglomerating. As a result, it is easy to charge the toner 35 through friction and sufficiently stir the toner 35.

In the embodiment, the toner transportation paddle 37 includes the rod members 44 and 45, and may include three rod members or a single rod member. Since it is necessary to provide the space between the rod members for toner passing therethrough, it is preferred that the toner transportation paddle 37 includes two to four rod members.

An experiment was conducted to obtain an optimum value of the space between the toner supply roller 38 and the toner transportation paddle 37. Table 1 shows a result of the experiment. In the experiment, the space between the toner supply roller 38 and the toner transportation paddle 37 was changed, and the following factors were evaluated: a number of times that the rod members 44 and 45 moved close to the toner supply roller 38 or a number of approaching movements when the toner supply roller 38 made one rotation; drum fog evaluation (color difference ΔE); a potential of the toner layer on the developing roller 39; an amount of the toner 35 on the developing roller 39 (toner sticking amount); and a charge amount of the toner 35 on the developing roller 39 (toner charge amount).

In the drum fog evaluation, when a color difference ΔE was equal to or smaller than 1.0, the result was designated as good. When the color difference ΔE was greater than 1.0, the result was designated as poor. In the embodiment, the toner transportation paddle 37 has a bar shape. Accordingly, in the experiment, the number of approaching movements of the toner transportation paddle 37 was equal to the number of times that the rod members 44 and 45 moved close to the toner supply roller 38 when the toner supply roller 38 made one rotation.

TABLE 1

| | 1 | 2 | 3 | 4 | 5 | 6 |
|---|---|---|---|---|---|---|
| Space between the toner supply roller 38 and the toner transportation paddle 37 (mm) | 1.50 | 1.00 | 0.80 | 0.50 | 0.30 | 0.00 |
| Number of approaching movements | 2.50 | 2.50 | 2.50 | 2.50 | 2.50 | 2.50 |
| Drum fog evaluation | poor | poor | good | good | good | good |
| Drum fog (color difference ΔE) | 1.33 | 1.21 | 1.00 | 1.00 | 0.80 | 0.70 |
| Potential of the toner layer on the developing roller 39 (V) | −65.40 | −63.00 | −73.00 | −69.40 | −72.30 | −71.50 |
| Amount of the toner 35 on the developing roller 39 (g/mm$^2$) | 0.52 | 0.52 | 0.51 | 0.53 | 0.52 | 0.51 |
| Charge amount of the toner 35 on the developing roller 39 (μq/g) | −24.43 | −23.39 | −27.54 | −24.38 | −26.52 | −27.27 |
| Torque (kg/cm) | 4.3 | 4.3 | 4.3 | 4.3 | 4.3 | 4.5 |

As shown in Table 1, when the space was less than 0.80 mm, the potential of the toner layer on the developing roller 39 became around −70.00 (V) and the drum fog became less than 1.00. However, when an outer circumference tolerance of the toner transportation paddle 37 is considered to be ±0.20 mm, in order to make the toner transportation paddle 37 not contacting with the toner supply roller 38, it is preferred that the space is between 0.30 mm and 0.80 mm.

As described above, in the embodiment, the toner supply roller 38 rotates in the direction the same as that of the developing roller 39 at a circumferential speed different from that of the developing roller 39. Accordingly, it is possible to supply the toner 35 to the developing roller 39 according to a difference in voltages applied to the toner supply roller 38 and the developing roller 39, and to remove the toner 35 remaining on the outer circumferential surface of the developing roller 39.

In the embodiment, the toner supply roller 38 is formed of an elastic foam member such as a silicone rubber and a urethane rubber, and has a plurality of cells (not shown) formed of recessed portions in a surface thereof.

When the developing roller 39 rotates, the toner 35 on the developing roller 39 is transported to the developing blade 40. After the developing blade 40 controls a thickness of the toner layer, the toner 35 is transported to a developing area facing the photosensitive drum 31. In the developing area, the toner 35 is attracted to the latent image on the photosensitive drum 31 through static electricity, thereby forming the toner image.

A method of reducing the drum fog will be explained next. As described above, the extent of the drum fog can be defined by the color difference ΔE of the toner 35 stuck to the photosensitive drum 31. A small value of the color difference ΔE represents less extent of the drum fog. In the embodiment, upon forming an image, an acceptable level of the drum fog is the color difference ΔE of equal to or less than 1.0, in which color smear in the white portion of the sheet P is hardly visible.

The drum fog was evaluated through the following process. First, after forming an image, the toner 35 remaining on the photosensitive drum 31 was collected on a tape, and the tape was attached to a white sheet (tape 1). Then, a tape without the toner 35 was attached to the white sheet as a reference (tape 2). The color difference ΔE between the tape 1 and the tape 2 was measured with a spectrum calorimeter (CM2600D; a product of Konica Minolta). A value of the color difference ΔE represents the extent of the drum fog.

An experiment was conducted to reduce the drum fog. In the experiment, it was found that the number of approaching movements of the toner transportation paddle 37 had an influence on the drum fog. In the experiment, a relationship was established between the toner fog and the number of approaching movements of the toner transportation paddle 37 with respect to the toner supply roller 38.

Figure 7:
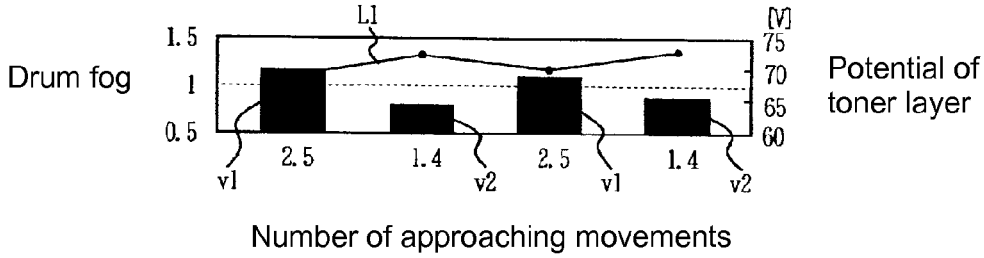
FIG. 7 is a graph No. 1 showing a relationship between a number of approaching movements and toner fog or a potential of a toner layer on a developing roller according to the first embodiment of the present invention.

FIG. 7 is a graph No. 1 showing the relationship between the number of approaching movements and the toner fog or the potential of the toner layer on the developing roller 39 according to the first embodiment of the present invention. In FIG. 7, a line L1 represents the drum fog, and bars vi (v1 to v4) represent the potential of the toner layer on the developing roller 39. When the number of approaching movements was changed alternately between 2.5 and 1.4, the drum fog L1 and the potential vi of the toner layer on the developing roller 39 were changed as shown in FIG. 7. In the experiment, by changing the number of approaching movements alternately, reproducibility was also evaluated.

As shown in FIG. 7, when the number of approaching movements is increased to 2.5, the potential vi of the toner layer on the developing roller 39 increases and the drum fog L1 decreases. Further, the result show good reproducibility.

An experiment was conducted to determine an optimum number of approaching movements for maintaining the drum fog L1 less than 1.0. Table 2 shows a configuration of a drive mechanism used in the experiment.

TABLE 2

| | Photosensitive drum | Drive roller ← | Drive roller → | Idle roller | Toner supply roller ← | Toner supply roller → | Toner transportation paddle |
|---|---|---|---|---|---|---|---|
| Teeth number | 38 | 17 | 16 | 18 | 25 | 26 | 20 |
| Outer diameter (mm) | 30 | 20 | | | 15 | | 5.4 |
| Number of approaching movements | | | | | 1.00 | | 2.50 |

As shown in Table 2, the drive mechanism included the photosensitive drum 31, the drive roller 21, the idle roller 20, the toner supply roller 38, and the toner transportation paddle 37. In the drive mechanism, when the teeth numbers of a spur gear of the toner supply roller 38 and a spur gear of the toner transportation paddle 37 were changed, it was possible to change the number of approaching movements of the toner transportation paddle 37 with respect to the toner supply roller 38 without changing circumferential speeds of the toner supply roller 38 and the toner transportation paddle 37.

Note that each of the drive roller 21 and the toner supply roller 38 had two spur gears. One of the two spur gears of the drive roller 21 engaging a spur gear of the photosensitive drum 31 had a teeth number different from that of the other of the two spur gears of the drive roller 21 engaging a spur gear of the idle roller 20. Similarly, one of the two spur gears of the toner supply roller 38 engaging the spur gear of the idle roller 20 had a teeth number different from that of the other of the two spur gears of the toner supply roller 38 engaging the spur gear of the toner transportation paddle 37.

Table 3 shows a result of the experiment. In the experiment, the teeth numbers of the spur gear of the toner supply roller 38 and the spur gear of the toner transportation paddle 37 were changed to change the number of approaching movements of the toner transportation paddle 37. Then, the following factors were evaluated: the drum fog evaluation (color difference ΔE); the potential of the toner layer on the developing roller 39; the amount of the toner 35 on the developing roller 39 (toner sticking amount); the charge amount of the toner 35 on the developing roller 39 (toner charge amount); and torque of the drum motor.

TABLE 3

| | 1 | 2 | 3 | 4 | 5 | 6 | 7 |
|---|---|---|---|---|---|---|---|
| Teeth number of the toner supply roller 38 | 24 | 24 | 24 | 24 | 24 | 24 | 25 |
| Teeth number of the toner transportation paddle 37 | 30 | 26 | 22 | 19 | 17 | 11 | 10 |
| Number of approaching movements | 1.60 | 1.85 | 2.18 | 2.53 | 2.82 | 4.36 | 5.00 |
| Drum fog evaluation | poor | poor | poor | good | good | good | good |
| Drum fog (color difference ΔE) | 1.66 | 1.54 | 1.42 | 0.98 | 0.93 | 0.86 | 0.78 |
| Potential of the toner layer on the developing roller 39 (V) | −53.20 | −54.40 | −64.00 | −65.80 | −73.00 | −70.00 | −69.40 |
| Amount of the toner 35 on the developing roller 39 ($g/mm^2$) | 0.45 | 0.46 | 0.51 | 0.51 | 0.51 | 0.49 | 0.53 |
| Charge amount of the toner 35 on the developing roller 39 (μq/g) | −27.03 | −26.32 | −24.23 | −25.18 | −27.54 | −28.92 | −24.38 |
| Torque (kg/cm) | 4.00 | 4.10 | 4.20 | 4.30 | 4.50 | 4.80 | 7.00 |

The experiment was conducted under an environment at a moderate temperature and a moderate humidity, i.e., 25° C. and 60%. In the experiment, the image forming units 15Bk, 15Y, 15M, and 15C had the configuration shown in FIGS. 2 and 3. The space between the toner supply roller 38 and the toner transportation paddle 37 was 0.8 mm.

When the spur gear of the toner supply roller 38 had the teeth number of 24 and the spur gear of the toner transportation paddle 37 had the teeth number of 30, the toner transportation paddle 37 rotated for N rotations while the toner supply roller 38 rotated one rotation, in which N=24/30=0.8. As described above, in the embodiment, the toner transportation paddle 37 has the rod members 44 and 45. Accordingly, when the toner transportation paddle 37 rotates for 0.8 rotations, the number of approaching movements of the toner transportation paddle 37 with respect to the toner supply roller 38 becomes 1.60, i.e., double of N (2×N)

As shown in Table 3, when the number of approaching movements of the toner transportation paddle 37 with respect to the toner supply roller 38 was 1.60, the drum fog was 1.66; the potential of the toner layer on the developing roller 39 was −53.2 V; and the amount of the toner 35 on the developing roller 39 was 0.45 $g/mm^2$. In the experiment, the number of approaching movements of the toner transportation paddle 37 with respect to the toner supply roller 38 was changed at seven levels from 1.60 to 5.0 to establish the relationship between the toner fog and the number of approaching movements of the toner transportation paddle 37 with respect to the toner supply roller 38.

When the drum motor generates a high torque, a current value supplied to the drum motor increases, and a total current value of the printer may exceed specification. Accordingly, it is necessary to maintain the torque equal to or less than 6 kg/cm. From the result shown in Table 3, it is preferably to maintain the number of approaching movements of the toner transportation paddle 37 equal to or less than 4.36 to maintain the torque equal to or less than 6 kg/cm.

An influence of the rotational speed of the toner transportation paddle 37 on the torque will be explained. In the embodiment, the toner 35 is filled around the toner transportation paddle 37. When the toner transportation paddle 37 rotates, the toner 35 receives resistance varied according to humidity, a packed density (increasing upon finely vibrating), and the like. Since the toner transportation paddle 37 has the tuning fork shape, as opposed to a roller shape, the toner 35 receives greater resistance greatly varied according to the rotational speed of the toner transportation paddle 37.

Figure 8:
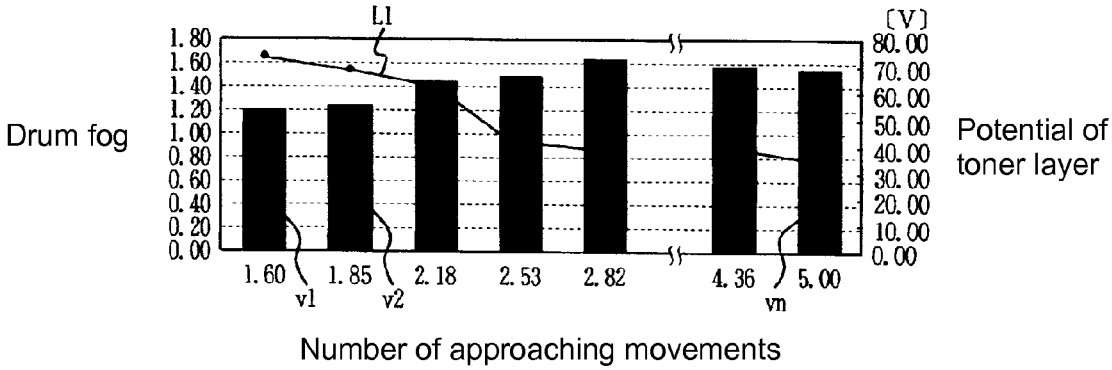
FIG. 8 is a graph No. 2 showing a relationship between a number of approaching movements and toner fog or a potential of a toner layer on a developing roller according to the first embodiment of the present invention.

FIG. 8 is a graph No. 2 showing a relationship between the number of the approaching movements and the toner fog or the potential of the toner layer on the developing roller 39 according to the first embodiment of the present invention. In FIG. 8, a horizontal axis represents the number of the approaching movements, and a vertical axis represents the toner fog or the potential of the toner layer on the developing roller 39 (FIG. 1).

In FIG. 8, a line L1 represents the drum fog, and bars vi (v1 to n) represent the potential of the toner layer on the developing roller 39. As shown in FIG. 8, when the number of approaching movements is increased, the potential vi of the toner layer on the developing roller 39 increases and the drum fog L1 improves.

From Table 1, Table 3, and FIG. 8, it is found that the drum fog became equal to or less than 1.0 when the number of approaching movements was equal to or greater than 2.50. Note that, in another experiment, similar to the case that the space between the toner supply roller 38 and the toner transportation paddle 37 was 0.8 mm, the same result was obtained when the space was 0.5, 0.3, and 0.0 mm. However, it is preferred that the number of approaching movements is maintained equal to or smaller than 4.36 to prevent the torque from increasing.

As explained above, in the embodiment, the number of approaching movements is maintained equal to or less than 2.50. Accordingly, it is possible to maintain the drum fog equal to or less than 1.0, thereby preventing the surface fog on the sheet P and improving image quality. Note that the space between the toner transportation paddle 37 and the toner supply roller 38 is maintained between 0.5 and 0.8 mm.

Second Embodiment

A second embodiment of the present invention will be explained next. Components in the second embodiment similar to those in the first embodiment are designated with the same reference numerals, and explanations thereof are omitted. The components similar to those in the first embodiment provide the similar effects.

Figure 9:
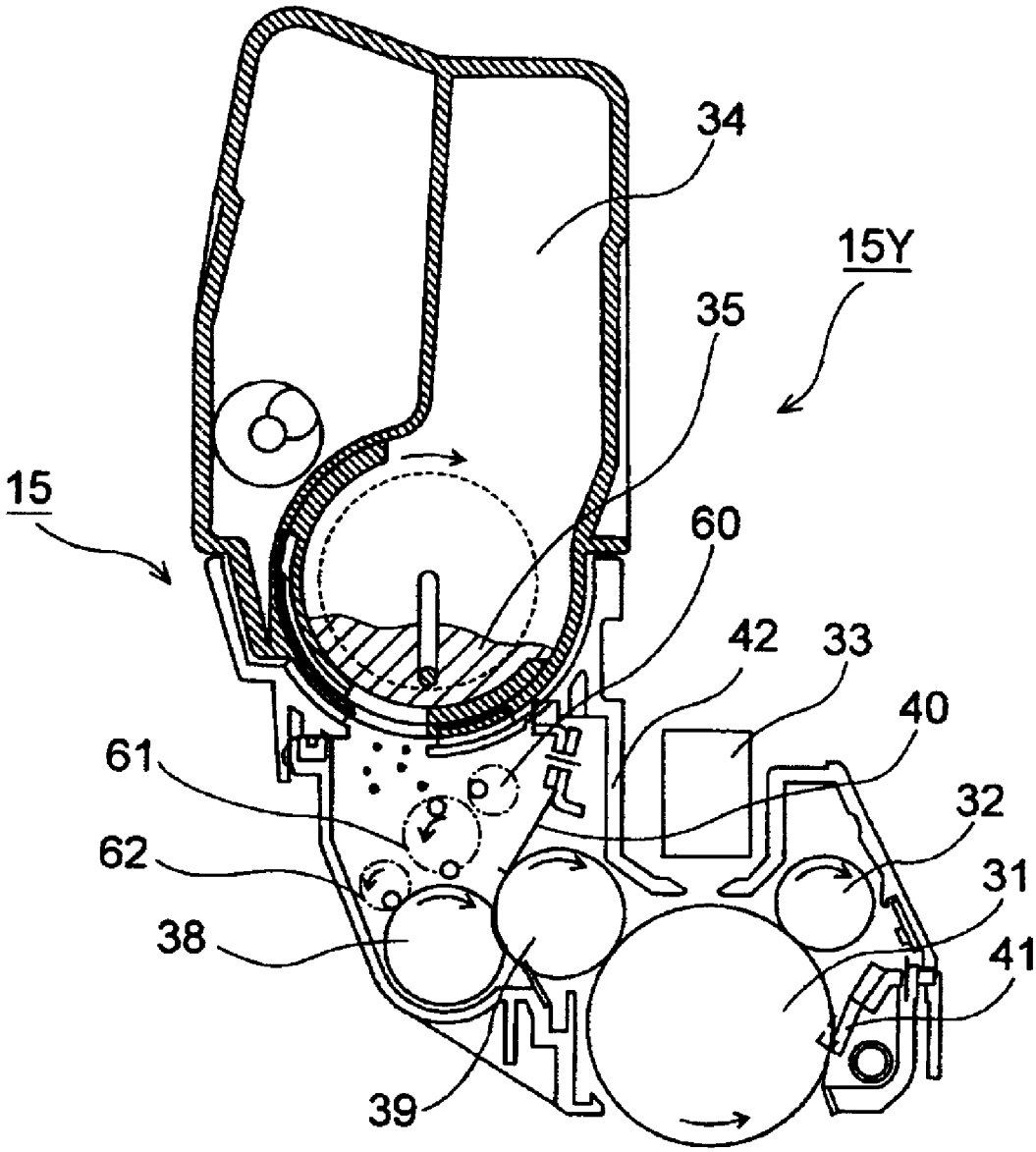
FIG. 9 is a schematic sectional view showing an image forming unit according to a second embodiment of the present invention.

FIG. 9 is a schematic sectional view showing the image forming unit 15Y according to a second embodiment of the present invention.

As shown in FIG. 9, a stirring member 60 is disposed under the toner storage container 34 for stirring the toner 35 supplied from the toner storage container 34 as a developer storage container. Toner transportation paddles 61 and 62 are disposed around the toner supply roller 38 as a first developer pushing member and a second developer pushing member, respectively, for pushing the toner 35 toward the toner supply roller 38.

In order to obtain an image with high quality, it is preferred that the toner 35 has a small particle size, for example, less than 8.0 μm, in a case of pulverized toner. In a case of polymerised toner, when the toner 35 has a substantially spherical shape with a sphericity of greater than 0.97, even if the toner 35 has a small particle size, flowability is not lowered. However, in the case of the pulverized toner, when the toner 35 has a spherical shape with a sphericity of less than 0.97, especially equal to or less than 0.95, and a particle size of less than 8.0 μm, flowability is lowered even though an amount of an outside addition is increased.

For example, when the toner 35 has a spherical shape with a sphericity of 0.95 and a particle size of 10.0 μm, flowability becomes 80% measured with an agglomeration method. However, when the toner 35 has a spherical shape with a sphericity of less than 0.95 and a particle size of 8.0 μm, flowability becomes 60% measured with the agglomeration method.

Table 4 shows mechanical conditions necessary for the toner transportation paddle such as the rotational speed of the photosensitive drum and the number of the toner transportation paddles with respect to the particle diameter of the toner, i.e., an average particle diameter.

TABLE 4

| Average particle diameter of the toner | Rotational speed of the photosensitive drum | Number of the toner transportation paddles |
|---|---|---|
| 10 μm | 97 rpm | 1 |
| 8 μm | 144 rpm | more than 2 |

The average particle diameter was measured as a volume average diameter with Coulter Multisizer 3 (product of Beckman Coulter K.K.) at an aperture diameter of 100 μm in a 3000-count measurement. The sphericity was measured as follows. First, a circularity was measured with a flow-type particle image analyzer FPIA-2100 (a product of Sysmex Corporation), and calculated as a quotient of a circumferential length of a circle having a projected area the same as a particle image divided by a circumferential length of a projected image of a particle. Then, the sphericity was calculated as a quotient of a total circularity of all particles thus measured divided by the total number of all particles thus measured, i.e., 3000 in this case.

The sphericity is an indicator of irregularity of the toner particles. When the toner particles are close to a perfect sphere, the sphericity becomes close to 1.000, and the sphericity decreases as irregularity of the toner particles increases.

Agglomeration was measured as follows. First, three types of meshes, i.e., 150 μm, 75 μm, and 45 μm, were stacked with the coarse mesh, i.e., 150 μm, at top. Then, 4.0 g of the toner 35 was weighed, and placed on the 150 μm mesh. Afterward, the three stacked meshes with the toner 35 placed thereon were set in Powder Tester PT-N (a product of Hosokawa Micron Corporation), so that the meshes were vibrated at a vibration adjustment dial of 1.5 (an amplitude of 1.0 mm) for 15 seconds. After the vibration, the meshes were separated and a weight of the toner 35 in each of the meshes was weighed. The extent of agglomeration was measured through the following equation.

$$EOA(\%)=(w1\times100)/4+(w2\times100)\times(3/5)/4+(w3\times100)\times(1/5)/4$$

where EOA is the extent of agglomeration (%); w1 is the weight of the toner 35 remaining in the 150 μm mesh; w2 is the weight of the toner 35 remaining in the 75 μm mesh; and w1 is the weight of the toner 35 remaining in the 45 μm mesh.

The flowability (%) is calculated by subtracting the extent of agglomeration (%) from 100 (%).

As shown in Table 4, when the toner 35 was the pulverized toner having the average particle size of 10 μm and the sphericity of less than 0.97 (irregular shape), the toner 35 had high flowability and was difficult to agglomerate. Accordingly, even when the photosensitive drum 31 rotated at a low speed, i.e., 97 rpm, it was sufficient to provide the single toner transportation paddle.

On the other hand, when the toner 35 had the average particle size of 8 μm, the toner 35 had low flowability and tended to agglomerate. Accordingly, even when the photosensitive drum 31 rotated at a high speed, i.e., 144 rpm, it was necessary to provide more than two toner transportation paddles to increase the toner charge amount and the toner supply amount per unit time.

In the second embodiment, two of the toner transportation paddles 61 and 62 are disposed around the toner supply roller 38 for increasing the toner charge amount and the toner supply amount per unit time. Further, with the toner transportation puddles 61 and 62, it is possible to enlarge a stirring area of the toner 35. Accordingly, it is possible to sufficiently stir the toner 35 and easily charge the toner 35 through friction, thereby increasing the toner charge amount per unit time.

When the toner transportation paddles 61 and 62 are disposed around the toner supply roller 38, a load to the drum motor driving the toner transportation paddles 61 and 62 increases. That is, the toner 35 is filled around the toner transportation paddles 61 and 62, and the toner 35 tends to be packed upon receiving fine vibrations when the toner 35 is transported to the image forming units 15Y, 15M, 15C, and 15Bk. As a result, the load to the drum motor significantly increases.

To solve the problem described above, a cross section of the toner transportation paddles 61 and 62 may be reduced. However, this measure has limitations. Accordingly, it is configured that the toner transportation paddles 61 and 62 rotate at a lower rotational speed.

Further, to solve the problem described above, similar to the first embodiment, the toner transportation paddles 61 and 62 may be formed of two rod members (FIG. 6) having the tuning fork shape. However, in this measure, it is difficult to dispose the toner transportation paddles having the tuning fork shape due to space limitation limitations.

As described above, in the toner transportation paddle 37 having the tuning fork shape, the space 37*a* is formed at the middle portion of the toner transportation paddle 37, so that the toner 35 passes therethrough. In the space 37*a*, it is necessary to make the space w1 between the rod members 44 and 45 greater than 5.0 mm to prevent a blurred image when the printing operation is performed continuously. When the toner transportation paddle 37 rotates, the toner 35 falls through the space 37*a*. Accordingly, when the space w1 is small, the toner 35 does not fall freely, thereby making it difficult to prevent a blurred image.

Further, when the toner transportation paddle 37 has the tuning fork shape, it is necessary to weld the toner transportation paddle 37 if the toner transportation puddle 37 is formed of metal, thereby increasing cost. Accordingly, it is preferred that the toner transportation paddle 37 is formed of a resin. In this case, the rod members 44 and 45 need to have an outer diameter d of at least 1.0 mm to provide sufficient strength.

For the reasons described above, when the toner transportation paddles 61 and 62 have the tuning fork shape, it is necessary to provide an enough space for disposing the toner transportation paddles 61 and 62. In the second embodiment, the toner transportation paddle 61 disposed close to the developing roller 39 has the tuning fork shape, and the toner transportation paddle 62 away from the developing roller 39 has a crank shape.

When the toner transportation paddle 61 is disposed close to the developing roller 39 and has the tuning fork shape, the toner transportation paddle 61 approaches close to the toner supply roller 38 more frequently than the toner transportation paddle 62. Accordingly, it is possible to charge the toner 35 more efficiently, thereby increasing the potential of the toner 35. That is, when the toner transportation paddle 61 approaches close to the toner supply roller 38 more frequently, the toner 35 is charged more efficiently through friction between the toner transportation paddle 61 and the toner 35.

When the toner 35 is charged with a large charge amount, it is possible to increase the potential of the toner supply roller 38. In general, the toner 35 tends to lose the charge amount thereof with time. Accordingly, it is preferred that the toner 35 is charged close to the nip portion between the toner supply roller 38 and the developing roller 39. When the toner transportation paddle 61 disposed close to the developing roller 39 has the tuning fork shape, it is possible to supply the toner 35 with a large charge amount.

Figure 10:
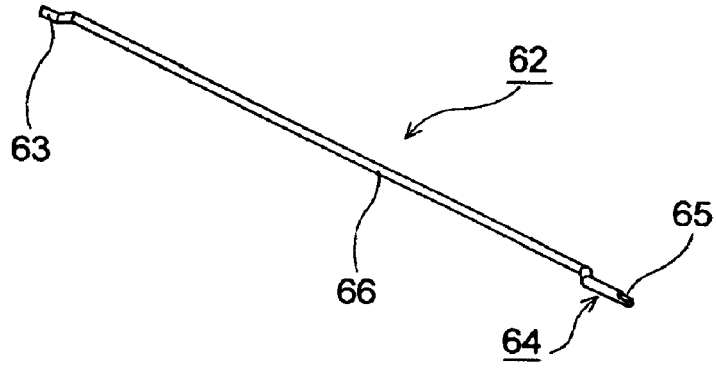
FIG. 10 is a perspective view showing a toner transportation paddle having a crank shape according to the second embodiment of the present invention.

FIG. 10 is a perspective view showing the toner transportation paddle 62 having the crank shape according to the second embodiment of the present invention.

As shown in FIG. 10, the toner transportation paddle 62 is formed of a single rod member 66 having the crank shape. The rod member 66 is shifted relative to rotational shafts 63 and 64. At least one of the rotational shafts 63 and 64, the rotational shaft 64 in the embodiment, has a cut portion to form a rotational transmission portion 65 with a semi-circular section. The rotational transmission portion 65 is connected to a motor as a drive unit (not shown) through a rotational transmission mechanism such as a gear, so that the toner transportation paddle 62 rotates at a specific rotational speed.

In the embodiment, the toner transportation paddle 62 rotates periodically at an upstream side of the nip portion between the toner supply roller 38 and the developing roller 39 in a rotational direction of the toner supply roller 38 (FIG. 9). Accordingly, the rod member 66 periodically approaches the toner supply roller 38. When the rod member 66 moves accompanying the rotation of the rod member 66, a space is formed inside a rotational path of the rod member 66.

In the embodiment, when the toner transportation paddle 61 approaches the toner supply roller 38, a space between the toner transportation paddle 61 and the toner supply roller 38 becomes equal to or less than 0.80 mm. When an outer circumference tolerance of the toner transportation paddle 37 is considered, it is preferred that the space is between 0.30 mm and 0.80 mm. Similarly, when the toner transportation paddle 62 approaches the toner supply roller 38, the space becomes equal to or less than 0.80 mm. When the outer circumference tolerance of the toner transportation paddle 37 is considered, it is preferred that the space is between 0.30 mm and 0.80 mm.

When the toner transportation paddle 62 has the crank shape, it is not necessary to provide a space for passing through the toner 35. Accordingly, it is possible to reduce the space for disposing the toner transportation paddles 61 and 62. Further, the toner transportation paddle 62 can be formed of metal. Accordingly, it is possible to decrease an outer diameter of the rod member 66, thereby reducing a size of the toner transportation paddle 62. As a result, it is possible to reduce a size of the image forming units 15Y, 15M, 15C, and 15Bk (FIG. 2).

Figure 11:
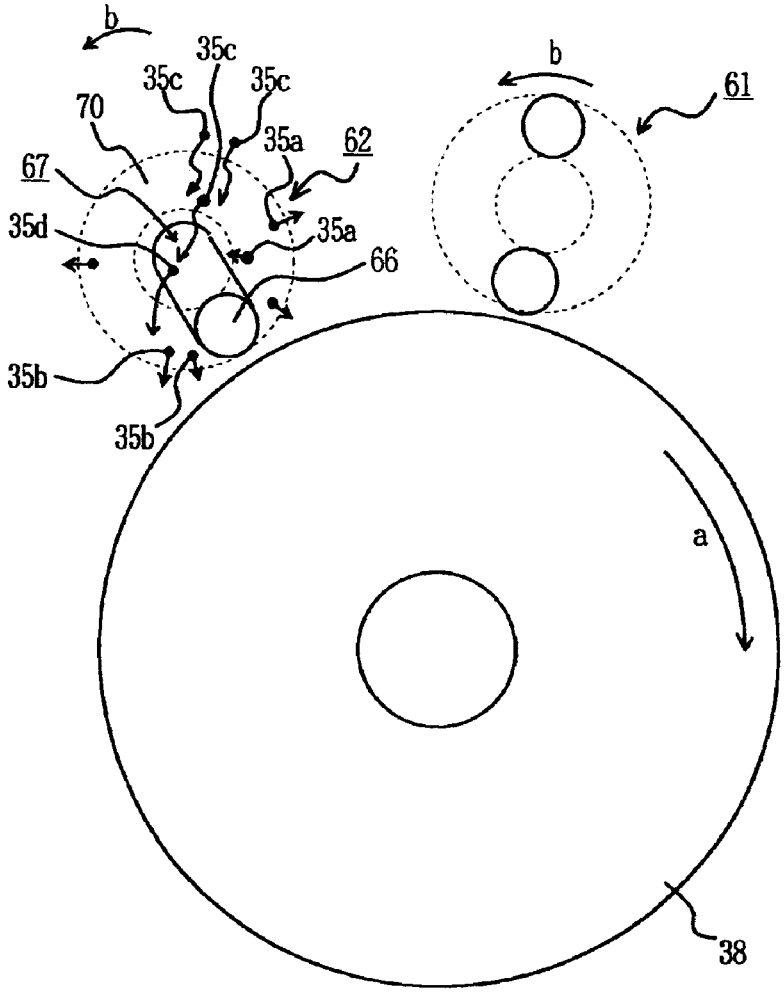
FIG. 11 is a schematic view showing a relationship between a toner supply roller and toner transportation paddles according to the second embodiment of the present invention.

An operation of the image forming unit 15C will be explained next. FIG. 11 is a schematic view showing a relationship between the toner supply roller 38 and the toner transportation paddles 61 and 62 according to the second embodiment of the present invention.

In the embodiment, the image forming unit 15Y performs a developing process of one-component developing type, in which one-component developer is used as the toner 35. The opening portion is formed at the lower portion of the toner storage container 34, so that the opening portion is freely opened and closed. When the opening is opened, a specific amount of the toner 35 in the toner storage container 34 drops to be supplied to the unit main body 15. In the unit main body 15, the stirring member 60 rotates to stir the toner 35, and the toner 35 is supplied to the toner transportation paddles 61 and 62.

In the embodiment, the toner supply roller 38 rotates in an arrow direction a. The toner transportation paddles 61 and 62 rotate in an arrow direction b opposite to that of the toner supply roller 38 at a circumferential speed different from that of the toner supply roller 38. The toner 35 is charged through friction (preliminary charging) at a portion where the space between the toner supply roller 38 and the toner transportation paddles 61 and 62 becomes minimum (0.8 mm).

In the embodiment, the toner transportation paddle 61 has the tuning fork shape, and the number of approaching movements thereof is maintained equal to or greater than 2.50. Further, the toner transportation paddle 62 has the crank shape, and the number of approaching movements thereof is maintained less than 2.50. The toner transportation paddle 61 is disposed adjacent to the developing roller 39. Accordingly, it is possible to make the potential of the toner layer on the developing roller 39 equal to that in the first embodiment.

When the number of approaching movements of the toner transportation paddle 61 increases, the potential of the toner layer on the developing roller 39 increases. The charges of the toner 35 do not disappear in a short period of time, and are maintained for a while. Accordingly, the toner 35 around the toner transportation paddle 61 having the larger number of approaching movements has the charge amount larger than that of the toner 35 around the toner transportation paddle 62 having the smaller number of approaching movements.

The charges of the toner 35 thus charged decrease with time, and the toner charge amount decreases with time. Accordingly, it is preferable to charge the toner 35 at a position close to the nip portion between the toner supply roller 38 and the developing roller 39. In the embodiment, the toner transportation paddle 61 disposed adjacent to the developing roller 39 has the larger number of approaching movements. Accordingly, it is possible to supply the toner 35 with a larger charge amount to the developing roller 39, thereby increasing the potential of the toner layer on the developing roller 39. Further, the toner transportation paddle 62 has the number of approaching movements the same as that in the first embodiment, and the space w1 is set the same as that in the first embodiment. Accordingly, the potential of the toner layer on the developing roller 39 becomes the same as that in the first embodiment.

Table 5 shows a result of an experiment. In the experiment, the number of approaching movements of the toner transportation paddles 61 and 62 were changed. Then, the following factors were evaluated: the drum fog evaluation (color difference ΔE); the potential of the toner layer on the developing roller 39; the amount of the toner 35 on the developing roller 39 (toner sticking amount); the charge amount of the toner 35 on the developing roller 39 (toner charge amount); the torque of the drum motor; and total evaluation results.

TABLE 5

(No. 1)

| | 1 | 2 | 3 | 4 | 5 | 6 |
|---|---|---|---|---|---|---|
| Number of approaching movements of the toner transportation paddle 61 | 2.50 | 2.50 | 1.30 | 2.50 | 3.00 | 3.00 |
| Number of approaching movements of the toner transportation paddle 62 | N/A | 1.30 | 2.00 | 2.50 | 2.00 | 1.50 |
| Drum fog evaluation | poor | good | poor | good | good | good |
| Drum fog (color difference ΔE) | 1.20 | 1.00 | 1.30 | 1.00 | 1.00 | 1.00 |
| Potential of the toner layer on the developing roller 39 (V) | −69.80 | −73.00 | −60.00 | −75.00 | −78.00 | −76.00 |
| Amount of the toner 35 on the developing roller 39 ($g/mm^2$) | 0.54 | 0.51 | 0.48 | 0.53 | 0.54 | 0.53 |
| Torque evaluation | good | good | good | poor | good | good |
| Torque (kg/cm) | 4.30 | 4.80 | 5.00 | 7.20 | 5.90 | 5.60 |
| Total evaluation | poor | good | poor | poor | good | good |

(No. 2)

| | 7 | 8 | 9 | 10 | 11 | 12 |
|---|---|---|---|---|---|---|
| Number of approaching movements of the toner transportation paddle 61 | 4.00 | 4.00 | 5.00 | 2.50 | 4.00 | 4.00 |
| Number of approaching movements of the toner transportation paddle 62 | 3.00 | 1.50 | 1.50 | 1.00 | 1.00 | 1.30 |
| Drum fog evaluation | good | good | good | poor | poor | good |
| Drum fog (color difference ΔE) | 1.00 | 1.00 | 1.00 | 1.20 | 1.10 | 0.90 |
| Potential of the toner layer on the developing roller 39 (V) | −80.00 | −80.00 | −81.00 | −70.10 | −72.10 | −79.30 |
| Amount of the toner 35 on the developing roller 39 ($g/mm^2$) | 0.56 | 0.53 | 0.52 | 0.53 | 0.52 | 0.53 |
| Torque evaluation | poor | good | poor | good | good | good |
| Torque (kg/cm) | 6.80 | 5.80 | 7.00 | 4.40 | 5.30 | 5.60 |
| Total evaluation | poor | good | poor | poor | poor | good |

(No. 3)

| | 13 | 14 | 15 | 16 | 17 |
|---|---|---|---|---|---|
| Number of approaching movements of the toner transportation paddle 61 | 2.50 | 5.00 | 4.00 | 1.30 | 5.00 |
| Number of approaching movements of the toner transportation paddle 62 | 2.00 | 1.30 | 2.00 | 1.30 | 2.00 |
| Drum fog evaluation | good | good | good | poor | good |
| Drum fog (color difference ΔE) | 1.00 | 1.00 | 0.80 | 1.50 | 0.80 |
| Potential of the toner layer on the developing roller 39 (V) | −77.00 | −79.50 | −81.30 | −58.60 | −81.70 |
| Amount of the toner 35 on the developing roller 39 ($g/mm^2$) | 0.53 | 0.53 | 0.55 | 0.46 | 0.57 |
| Torque evaluation | good | poor | good | good | poor |
| Torque (kg/cm) | 5.85 | 6.80 | 5.90 | 4.40 | 6.50 |
| Total evaluation | good | poor | good | poor | poor |

In the experiment, the toner 35 was irregular shape toner having a sphericity of 0.95 and a particle size of 6.0 μm. In the torque evaluation, when the torque of the drum motor was equal to or less than 6 kg/cm, the result was designated as good, and when the torque of the drum motor was greater than 6 kg/cm, the result was designated as poor. The drum fog evaluation was conducted the same as the first embodiment.

As shown in Table 5, with respect to the drum fog and the potential of the toner layer on the developing roller 39, it was sufficient that the number of approaching movements of the toner transportation paddle 61 was maintained equal to or greater than 2.50, and the number of approaching movements of the toner transportation paddle 62 was maintained equal to or greater than 1.30. When the number of approaching movements of the toner transportation paddle 61 became less than 2.50, or the number of approaching movements of the toner transportation paddle 62 became less than 1.30, the drum fog became worse.

With respect to the torque evaluation, it was sufficient that the number of approaching movements of the toner transportation paddle 61 was maintained equal to or less than 4.00, and the number of approaching movements of the toner transportation paddle 62 was maintained equal to or less than 2.00. When the number of approaching movements of the toner transportation paddle 61 became greater than 4.00, or the number of approaching movements of the toner transportation paddle 62 became greater than 2.00, the torque of the drum motor increased too much. In the experiment, the space between the toner supply roller 38 and the toner transportation paddles 61 and 62 was 0.8 mm. Note that, in another experiment, the same result was obtained when the space was within a range between 0.0 and 0.8 mm.

Note that an operation of the toner transportation paddle 61 is the same as that of the toner transportation paddle 37 in the first embodiment, and explanation thereof is omitted.

As shown in FIG. 11, when the toner transportation paddle 62 rotates, the toner 35*a* on a moving path 70 of the toner transportation paddle 62 is pushed outward or inward the moving path 70 while the rod member 66 is rotating. Accordingly, a space is formed on the moving path 70 while the toner transportation paddle 62 is rotating. The toner 35*c* above the toner transportation paddle 62 enters the space on the moving path 70, and reaches to a middle portion 67 of the toner transportation paddle 62.

The toner 35*d* enters the space on the moving path 70 formed through the rotation of the toner transportation paddle 62, and further is pushed outward or inward in the radial direction with the rod member 66 rotating one rotation. The toner 35*b* pushed outward below the toner transportation paddle 62 is pushed toward the toner supply roller 38.

Accordingly, the toner transportation paddle 62 having the crank shape generates the flow of the toner 35, thereby preventing the toner 35 from agglomerating. As a result, it is easy to charge the toner 35 through friction and sufficiently stir the toner 35 due to the flow thus generated.

As described above, in the second embodiment, a plurality of the toner transportation paddles 61 and 62 is disposed around the toner supply roller 38. The toner transportation paddle 61 disposed close to the developing roller 39 has the tuning fork shape. The toner transportation paddle 61 stirs the toner 35 at a low rotational speed, thereby reducing the torque.

In the embodiments described above, the printer is explained as an image forming apparatus. The image forming apparatus may include a copier, a facsimile, a multifunction device, and the like.

The disclosure of Japanese Patent Application No. 2006-066918, filed on Mar. 13, 2006, is incorporated in the application.

While the invention has been explained with reference to the specific embodiments of the invention, the explanation is illustrative and the invention is limited only by the appended claims.

What is claimed is:

1. An image forming unit comprising:

an image supporting member for forming a latent image;

a developer supporting member for attaching developer to the latent image to develop the latent image;

a developer supply member facing the developer supporting member for supplying the developer to the developer supporting member; and a first paddle member facing the developer supply member to be freely rotatable, said first paddle member including a first rod member disposed substantially in parallel to the developer supply member so that the first rod member moves close to the developer supply member equal to or more than 2.50 times when the developer supply member rotates one rotation.

2. The image forming unit according to claim 1, wherein said first rod member is arranged to move close to the developer supply member equal to or less than 4.36 times when the developer supply member rotates one rotation.

3. The image forming unit according to claim 1, wherein said first paddle member includes a plurality of first rod members.

4. The image forming unit according to claim 1, further comprising a second paddle member disposed at an upstream side of the first paddle member in a rotational direction of the developer supply member, said second paddle member including a second rod member disposed substantially in parallel to the developer supply member.

5. The image forming unit according to claim 4, wherein said first paddle member is arranged at a position closer to the developer supporting member than the second paddle member, said first rod member moving close to the developer supply member equal to or less than 4.00 times when the developer supply member rotates one rotation.

6. The image forming unit according to claim 4, wherein said second rod member is arranged to move close to the developer supply member between 1.30 times and 2.00 times when the developer supply member rotates one rotation.

7. The image forming unit according to claim 4, wherein said second rod member is formed of one single member.

8. An image forming apparatus, comprising:

a medium storage unit for storing a medium;

a sheet supply unit for supplying the medium from the medium storage unit;

an image forming unit for forming a developer image;

a transfer unit for transferring the developer image to the medium; and a fixing unit for fixing the developer image to the medium, wherein said image forming unit includes, an image supporting member for forming a latent image;

a developer supporting member for attaching developer to the latent image to develop the latent image;

a developer supply member facing the developer supporting member for supplying the developer to the developer supporting member; and a first paddle member facing the developer supply member to be freely rotatable for supplying the developer to the developer supply member, said first paddle member including a first rod member disposed substantially in parallel to the developer supply member so that the first rod member moves close to the developer supply member equal to or more than 2.50 times when the developer supply member rotates one rotation.

9. The image forming apparatus according to claim 8, wherein said first rod member is arranged to move close to the developer supply member equal to or less than 4.36 times when the developer supply member rotates one rotation.

10. The image forming apparatus according to claim 8, wherein said first paddle member includes a plurality of first rod members.

11. The image forming apparatus according to claim 8, further comprising a second paddle member disposed at an upstream side of the first paddle member in a rotational direction of the developer supply member, said second paddle member including a second rod member disposed substantially in parallel to the developer supply member.

12. The image forming apparatus according to claim 11, wherein said first paddle member is arranged at a position closer to the developer supporting member than the second paddle member, said first paddle member moving close to the developer supply member equal to or less than 4.00 times when the developer supply member rotates one rotation.

13. The image forming apparatus according to claim 11, wherein said second rod member is arranged to move close to the developer supply member between 1.30 times and 2.00 times when the developer supply member rotates one rotation.

14. The image forming apparatus according to claim 11, wherein said second rod member is formed of one single member.

* * * * *